US010352501B2

(12) United States Patent
Wikus et al.

(10) Patent No.: US 10,352,501 B2
(45) Date of Patent: Jul. 16, 2019

(54) CRYOSTAT WITH ACTIVE NECK TUBE COOLING BY A SECOND CRYOGEN

(71) Applicant: Bruker BioSpin GmbH, Rheinstetten (DE)

(72) Inventors: Patrick Wikus, Nürensdorf (CH); Steffen Bonn, Zürich (CH)

( * ) Notice: Subject to any disclaimer, the term of this patent is extended or adjusted under 35 U.S.C. 154(b) by 385 days.

(21) Appl. No.: 15/194,923

(22) Filed: Jun. 28, 2016

(65) Prior Publication Data

US 2017/0002979 A1 Jan. 5, 2017

(30) Foreign Application Priority Data

Jul. 1, 2015 (DE) ..... 10 2015 212 314

(51) Int. Cl.
*F17C 3/08* (2006.01)
*H01F 6/04* (2006.01)

(52) U.S. Cl.
CPC ..... *F17C 3/085* (2013.01); *H01F 6/04* (2013.01); *F17C 2221/014* (2013.01); *F17C 2221/017* (2013.01); *F17C 2250/00* (2013.01); *F17C 2260/031* (2013.01); *F17C 2270/02* (2013.01)

(58) Field of Classification Search
CPC ..... H01F 6/04; F17C 3/085; F17C 2221/014; F17C 2221/017; F17C 2270/0527; F17C 2270/0536; F25D 19/00; F25D 19/006
See application file for complete search history.

(56) References Cited

U.S. PATENT DOCUMENTS

| | | | | |
|---|---|---|---|---|
| 3,358,472 | A | 12/1967 | Klipping | |
| 3,938,346 | A | 2/1976 | Ovchinnikov et al. | |
| 4,510,771 | A | 4/1985 | Matsuda et al. | |
| 2006/0021355 | A1 | 2/2006 | Boesel et al. | |
| 2007/0051115 | A1 | 3/2007 | Kraus et al. | |
| 2007/0051116 | A1 | 3/2007 | Glemot et al. | |
| 2007/0107445 | A1 | 5/2007 | Boesel et al. | |
| 2009/0094992 | A1* | 4/2009 | Wang | F25B 9/10 62/6 |
| 2010/0005814 | A1* | 1/2010 | Strobel | F25D 3/10 62/62 |

(Continued)

FOREIGN PATENT DOCUMENTS

| | | | |
|---|---|---|---|
| DE | 2449129 | A1 | 5/1975 |
| DE | 2723341 | A1 | 12/1978 |

(Continued)

*Primary Examiner* — Keith M Raymond
(74) *Attorney, Agent, or Firm* — Benoit & Côté Inc.

(57) ABSTRACT

A cryostat arrangement has an outer jacket, a first tank with a first cryogen, and a second tank with a second liquid cryogen which boils at a higher temperature than the first cryogen. The first tank comprises a neck tube, whose hot upper end is connected to the outer jacket at ambient temperature and whose cold lower end is connected to the first tank at a cryogenic temperature. The arrangement uses a riser pipe protruding into the second tank through which the second liquid cryogen can flow out of the second tank and into a first heat exchanger in thermal contact with the neck tube. An outflow line is provided through which second cryogen evaporating from the first heat exchanger can flow out and into an optional second heat exchanger. It is thus possible to greatly reduce heat input from the neck tube into the first tank.

20 Claims, 11 Drawing Sheets

(56) References Cited

U.S. PATENT DOCUMENTS

| | | | | |
|---|---|---|---|---|
| 2012/0242335 | A1* | 9/2012 | Schett | G01R 33/3403 324/318 |
| 2015/0007586 | A1 | 1/2015 | Kraus et al. | |

FOREIGN PATENT DOCUMENTS

| | | | |
|---|---|---|---|
| DE | 3414560 | C2 | 3/1987 |
| DE | 102004037173 | B3 | 12/2005 |
| DE | 102004034729 | B4 | 12/2006 |
| DE | 102005041383 | A1 | 3/2007 |
| DE | 102011005888 | B4 | 1/2014 |
| DE | 102013213020 | A1 | 1/2015 |

* cited by examiner

CRYOSTAT WITH ACTIVE NECK TUBE COOLING BY A SECOND CRYOGEN

BACKGROUND OF THE INVENTION

Field of the Invention

The invention relates to a cryostat arrangement for storage of a first cryogen, in particular for cooling an arrangement of superconducting magnets, having an outer jacket and a first tank with the first cryogen installed in the outer jacket as well as a second tank with a second liquid cryogen, wherein the first cryogen boils at a lower temperature than the second cryogen and wherein the first tank includes a neck tube, whose warm upper end is connected to the outer jacket at ambient temperature and whose cold lower end is connected to the first tank at a cryogenic temperature.

Such a cryostat arrangement is known from DE 10 2004 034 729 B4.

Description of the Related Art

The present invention relates in general to the field of cooling of technical systems, which should/must be kept at very low (=cryogenic) temperatures during operation. Such systems may include arrangements of superconducting magnets, such as those used in the field of magnetic resonance, for example, in MRI tomographs or NMR spectrometers. Such arrangements of superconducting magnets are usually cooled with liquid helium.

One of the development goals for superconducting magnetic systems is to reduce the consumption of liquid helium, which is equivalent to a reduction in the heat load on the helium tank in the case of bath-cooled systems.

One of the greatest contributions to the total heat load on the helium tank originates from the neck tubes, which connect the helium tank to the vacuum chamber, which is approximately at ambient temperature. Hence, thermal conduction in the neck tube is the most important source for thermal losses. Neck tubes have the function of enabling access to the helium tank in general. In the case of arrangements of superconducting magnets, this includes access for electrical connections or devices for refilling cryogens. In addition, the neck tubes serve as a vent path in the case of any excess pressure that might occur.

The neck tubes are typically made of stainless steel or some other suitable material having a low thermal conductivity. The neck tubes are usually connected at a suitable location to a heat sink, which has a higher temperature than the helium tank but provides a significantly higher cooling power at this higher temperature. A tank filled with liquid nitrogen is a typical example of such a heat sink.

To minimize the heat load on the helium tank, it is advantageous to place the connection between the neck tube and the heat sink (for example, a nitrogen tank) as high up as possible. The distance between the connection and the helium tank should therefore be maximized. However, there are practical limits to this. If the connection point is too high, the top end of the tube will be cooled down excessively and ice will form on the outside of the cryostat, which would at least be visually unattractive, or the heat load on the nitrogen tank becomes too large.

The connection between the nitrogen tank (referenced here as an example) and the neck tube is typically made of a material having a good thermal conductivity—for example, copper or aluminum.

A temperature gradient develops between the nitrogen tank and the connection point on the neck tube—due to the heat flow and the finite thermal conductivity of the connection. In practice, this typically amounts to a few degrees Kelvin, even when using materials of a high thermal conductivity (for example, aluminum or copper).

The two interfaces between the nitrogen tank and the connecting piece as well as between the connecting piece and the neck tube ("contact resistance") make a significant contribution to the temperature gradient between the heat sink (nitrogen tank in the example selected here) and the neck tube.

The geometry of the connecting piece also contributes to develop the temperature gradient. To limit the height of the system, the upper opening of the room temperature bore in the magnet is designed to be as low as possible. To nevertheless achieve the required neck tube length, the neck tubes extend in the outer tank through so-called towers. For the best possible access to the room temperature bore, these towers are designed to be as narrow as possible, which sets tight limits for the possible design of the geometric shape of the connecting piece.

U.S. Pat. No. 3,358,472 A describes a cryostat arrangement in which a stream of liquid helium is generated. This is used first to cool a magnetic coil and subsequently—when the helium has evaporated on the coil—to cool the radiation shields. The known cryostat thus works with an evaporator, in which helium is carried around the coil and evaporated there. Nitrogen is used for shield cooling only in the storage tank (the bottom tank in the figure). There is no device here for "raising" the nitrogen.

U.S. Pat. No. 4,510,771 discloses a device, which is a cryostat with two cryogens (namely helium and nitrogen) and has an active condenser. This condenser is used for precooling a stream of helium and is driven by the compressor of the active condenser. The nitrogen serves essentially to cool a radiation shield but otherwise plays no role in the cooling of the neck tube. It is also crucial that a system free of cryogen losses is proposed here ("zero boil off"), i.e., there is no change here in the filling level in the parts wetted by liquid nitrogen. Therefore, this prior art document also does not disclose any compensation of the effects of changes in filling level.

The patent DE 10 2004 034 729 B4, which was already cited in the introduction, discloses a cryostat arrangement for storing liquid helium, with an outer jacket and a helium tank installed in it, wherein the helium tank is connected to the outer jacket on at least two suspension tubes and includes a neck tube, whose hot upper end is connected to the outer jacket and whose cold lower end is connected to the helium tank, into which a multistage cold head of the cryocondenser is installed. The helium tank is surrounded by a radiation shield, which is connected in a thermally conducting manner to the suspension tubes as well as to a contact surface on the neck tube and the helium tank. The contact surfaces on the neck tube are each connected to a radiation shield by means of a rigid or flexible permanent heat bridge in a heat-conducting manner. In one embodiment, the radiation shield is cooled with liquid nitrogen, which is present in a separate tank connected to the neck tube by the heat bridge. However, a heat exchanger, which precools the neck tube by consuming nitrogen, is not disclosed. There is also no device for "raising" the nitrogen.

The temperature gradient referenced above means that the temperature of the neck tube at the coupling point does not reach the theoretical minimum value of 77K (if nitrogen is used). This is the temperature of boiling nitrogen at a pressure of 1 bar. The temperature of the neck tube at the coupling point instead tends to be between 80K and 85K.

In first approximation, the heat load $\dot{Q}$ is applied to the helium tank by heat transfer through the neck tube. At a constant neck tube cross section, this is proportional to the integral over the thermal conductivity λ of the neck tube material from the temperature of the helium tank (temperature=4.2K) to the temperature of the coupling point (temperature=$T_A$):

$$\dot{Q} \sim \int_{4.2\ K}^{T_A} \lambda(T) \cdot dT$$

For stainless steel, this thermal conductivity integral from 4.2K to 77K is approximately 326 W/m, and from 4.2K to 85K it is approximately 391 W/m. Thus, if it were possible to lower the temperature of the coupling point from 85K to 77K, the heat load due to thermal conduction in the neck tubes would decrease by 16% in first approximation.

Due to the declining liquid level in normal operation, the temperature of the coupling point is subject to constant changes. When the liquid level drops, the distance between the liquid surface and the coupling point increases and its temperature rises. The heat load on the helium tank thus increases when the filling level of the nitrogen tank decreases.

SUMMARY OF THE INVENTION

In comparison with the prior art discussed above, the present invention has the objective to reduce the heat input originating from the neck tubes into the first tank with the first cryogen—usually a helium tank—in a cryostat arrangement of the type described in the introduction. In particular, this objective is accomplished by using a second cryogen, which is normally much less expensive and is present anyway—usually liquid nitrogen, wherein equipment that is already available (e.g., the nitrogen tank) should be readily expandable by additional components (e.g., by a riser pipe).

This objective is achieved by the present invention in a manner that is just as surprisingly simple as it is effective—by the fact that with a cryostat arrangement of the type defined in the introduction, a riser pipe protruding into the second tank is arranged, so that the second liquid cryogen can flow out of the second tank and the lower end of the riser pipe ends in the second liquid cryogen in the second tank; a first heat exchanger is provided into which the riser pipe with its upper end opens directly or indirectly; the first heat exchanger has an outflow line through which the second cryogen can flow out of the first heat exchanger; and the first heat exchanger is in thermal contact with the neck tube, said neck tube providing local cooling by means of the second cryogen from the riser pipe.

The technology relevant for the present invention involves a cooling system for neck tubes of cryostats comprising at least two cryogens. Since the neck tubes are at ambient temperature on one end and protrude into the low-boiling helium at a temperature of 4.2K on the other end, the result is a temperature gradient of almost 300K over a length of a 70 cm neck tube in the specific case of a helium cryostat, which results in a relatively great heat loss. According to the inventive method, this gradient is reduced by a second cryogen (usually nitrogen), which has a higher boiling point and is usually much less expensive, since the outflowing nitrogen precools the neck tube by means of a heat exchanger, which is thermally connected to the neck tube.

The first cryogen is preferably helium and the second cryogen is preferably nitrogen.

The following advantages in particular are achieved with the present invention: The rate of evaporation of the first cryogen can be reduced significantly by more efficient precooling of the neck tube (since the temperature gradient between the nitrogen tank and the coupling point on the neck tube turns out to be much smaller). This results in a definite reduction in operating costs, on the one hand, while, on the other hand, the interval in which the first cryogen (typically helium) must be resupplied is extended, which reduces problems in long-term nuclear magnetic resonance (NMR) measurements and increases the availability of the system for NMR measurements on the whole.

An embodiment of the cryostat arrangement according to the invention is preferred, in which the level of the second liquid cryogen in the riser pipe is above the level in the second tank because of a pressure difference between the outflow line and the gas volume over the liquid surface in the second tank, in particular at the level of the first heat exchanger, wherein the first heat exchanger is fed with the second cryogen from the riser pipe. In particular, the first heat exchanger is fed with the second cryogen in the liquid phase The first heat exchanger preferably provides cooling to the neck tube with the enthalpy of evaporation of the second liquid cryogen, which performs the transition from liquid to gas phase in the heat exchanger.

For the specific case of a cryostat using nitrogen as the second cryogen: liquid nitrogen is particularly suitable for neck tube cooling because of its high latent heat, which can be made available for cooling by evaporation of liquid nitrogen, so it is advantageous to place the location where the phase transition occurs as close as possible to the coupling point on the neck tube. This is achieved by the fact that the level in the riser pipe is raised above the level in the nitrogen tank.

Another advantageous embodiment of the cryostat arrangement according to the invention is characterized in that an exhaust line, through which the second cryogen vents as it evaporates from the second tank, has a flow resistance device on the atmosphere end, in particular a dosing valve, preferably a control valve, and due to the flow resistance device in the exhaust line, a pressure difference can be achieved between the outflow line and the gas volume above the liquid surface in the second tank.

This embodiment is particularly simple and inexpensive to implement. However, it is presupposed that the heat load on the second tank is sufficiently high to obtain and to maintain an adequate pressure difference.

In another advantageous embodiment of the invention, a pump is provided on the atmosphere end of the outflow line, in particular a pump having a dosing valve, preferably a control valve, or a controllable pump, wherein a pressure difference between the outflow line and the gas volume over the liquid surface in the second tank can be realised by means of the pump in the outflow line.

The advantage of this embodiment is that a sufficiently great pressure difference can be achieved when the heat load on the second tank is not high enough. Then a sufficiently low pressure is easily established in the outflow line by means of the pump. An additional advantage of this pressure reduction in the outflow line is the temperature reduction in the phase transition and thus the further reduction in the neck tube temperature at the point of the first heat exchanger.

In a preferred class of embodiments of the invention, a second heat exchanger is arranged above the first heat exchanger, the second heat exchanger being in thermal contact with the neck tube and providing additional local cooling of the neck tube by means of the second cryogen evaporating out of the first heat exchanger.

In this way, not only the heat of evaporation but also the enthalpy contained in the cold gas can be used for cooling the neck tube. At the same time, this embodiment reduces the tendency for ice to form on the outflow line.

In additional preferred embodiments of the invention, a distributor tank, preferably designed in the form of a ring, is arranged on the cover of the second tank and in good thermal contact with the second tank. The second liquid cryogen is fed from the riser pipe into the distributor tank, and this cryogen can be conveyed further from the distributor tank into the first heat exchanger.

In this way, the cover of the second tank is cooled locally. This is advantageous because the cover region and components connected to the cover region are able to exchange heat with the helium tank particularly well by means of thermal radiation in many cryostat designs. The lower the temperature of the cover region, the lower is the heat load on the helium tank.

Also advantageous are embodiments of the cryostat arrangement according to the invention, in which the outflow line is connected directly or indirectly to a branch piece, wherein the branch piece is connected directly or via a flow resistance device to an exhaust line which is in turn connected to the second tank.

This ensures that the same pressure always prevails at the outlet of the outflow line and at the outlet of the exhaust line (i.e., in the branch piece), which simplifies control of the liquid level in the riser pipe.

In other advantageous embodiments of the cryostat arrangement according to the invention, a flow meter is provided in the outflow line for determining the flow rate of the second cryogen flowing out through the outflow line and/or a flow meter is provided in the exhaust line for determining the flow rate of the second cryogen outgassing through the exhaust line.

The pressure difference can be adjusted so that the measured flow corresponds to a desired ideal value. Since the flow rate is proportional to the cooling power, the cooling power can thus be adjusted easily.

In preferred embodiments, a temperature sensor is arranged on the neck tube in the region of the first heat exchanger and/or a second exchanger and/or on the neck tube.

Temperature sensors are particularly inexpensive and easy to use. A relevant parameter, which can be used to control the pressure difference, can be detected easily and inexpensively with a temperature sensor.

Additional advantageous embodiments of the invention are characterized in that a pressure sensor is arranged in the second tank, preferably near the bottom, in particular next to the lower end of the riser pipe, which is designed as an intake opening.

The pressure near the bottom of the second tank is calculated from the pressure over the liquid surface in the tank and from the density and the filling level of the cryogen in the second tank. To achieve a constant cryogen level in the riser tube, it is therefore sufficient to keep the pressure near the bottom of the second tank constant (presupposing that the same pressure prevails at the outlet of the outflow line and at the outlet of the exhaust line). This embodiment thus allows a particularly simple means of regulating the liquid at a constant level in the riser pipe.

In addition, in embodiments of the cryostat arrangement according to the invention, a filling level sensor may be provided in the second tank.

The filling level sensor provides information about the current hydrostatic pressure of the cryogen in the second tank. With this information, it is possible to re-adjust the pressure over the surface of the liquid in the second tank as the filling level drops in order to maintain the desired flow rate.

Here again, a particularly simple constant control of the liquid level in the riser pipe can be implemented, assuming that the same pressure prevails at the outlet of the outflow line and at the outlet of the exhaust line.

Variants of the invention in which the arrangement of superconducting magnets is part of an apparatus for nuclear magnetic resonance, in particular for magnetic resonance imaging (=MRI) or for magnetic resonance spectroscopy (=NMR) are particularly preferred.

Superconducting magnets for MRI or NMR are often immersed in liquid helium, but the limited availability of helium and its price are important factors to minimize helium losses. If the superconducting magnet is heated to the transition temperature, the entire apparatus must be taken off line and recharged.

A method for operation of a cryostat arrangement having the features described above also falls within the scope of the present invention if this method is characterized in that a pressure difference is established between the outflow line and the gas volume over the liquid surface in the second tank, thereby creating a flow of the second cryogen through the heat exchanger.

In this mode of operation, the consumption of the low-boiling first cryogen is reduced by consuming an inexpensive second cryogen, while the temperature gradient on the main thermal bridge, the neck tube, is reduced.

Variants of this method, which include the following steps, are particularly preferred:

i. detection of at least one parameter selected from a) the flow rate in the outflow line or in the exhaust line, b) the temperature at the neck tube, c) the pressure difference between the pressure in the second tank and the pressure on the outflow line or d) the filling level in the second tank, ii. Comparison with an ideal value of the respective parameter and iii. Adjusting the pressure difference between the outflow line and the gas volume over the liquid surface in the second tank, so that the respective measured parameters a)-c) correspond to predetermined ideal values and/or as a function of the filling level d) in the second tank.

The pressure difference $\Delta P$ between the pressure in the outflow line and the pressure in the gas space over the second liquid cryogen is $\Delta P=\rho_{cryogen2}\times g\times\Delta H$ (disregarding flow resistance device), where $\Delta H=H_S-H_B$ is the difference in the level of the second cryogen in the riser pipe ($H_S$) and in the second tank ($H_B$). In order for the level $H_S$ in the riser pipe to remain constant with a falling level $H_B$ in the second tank, the level difference $\Delta H$ and accordingly the pressure difference $\Delta P$ must increase $\Delta P=\text{constant}-\rho_{cryogen2}\times g\times H_B$.

Such a method with active control makes it possible to control the position of the liquid level in the riser pipe so that the level always comes to lie at the thermodynamically optimal point and thus a particularly efficient operation of the cryostat is possible.

Finally, an advantageous embodiment of the method is to adjust the pressure difference between the outflow line and the gas line over the liquid surface in the second tank by means of a pump or a flow resistance device.

The advantage of this embodiment is that a sufficiently great pressure difference can be established even when the heat load on the second tank is not high enough. In this case, the pressure in the outflow line can be lowered easily by using the pump. An important advantage of pressure reduction in the outflow line is the resulting reduction of the phase transition temperature and thus the further reduction of the neck tube temperature at the position of the first heat exchanger.

Additional advantages of the invention are derived from the description and the drawings. Likewise, the features mentioned above and those to be explained below may each be used individually according to the invention or several features may be used in any combination. The embodiments illustrated and described here are not to be understood as a complete list but instead are more in the nature of examples used to describe the invention.

BRIEF DESCRIPTION OF THE DRAWINGS

The invention is illustrated in the drawing and is explained in greater detail on the basis of exemplary embodiments, in which.

DETAILED DESCRIPTION

Figure 1A:
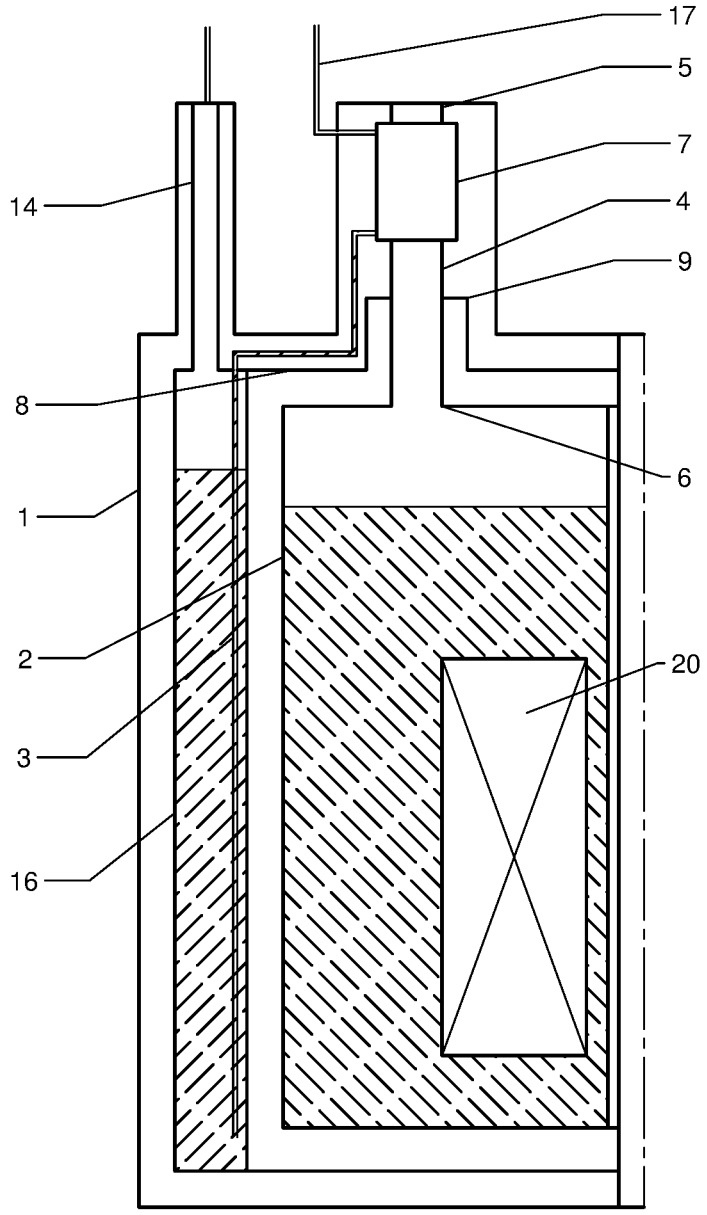
FIG. 1*a* shows a schematic vertical sectional view of a first embodiment of the cryostat arrangement according to the invention.

FIGS. 1*a* and 2 through 5 of the drawing each show in a schematic diagram preferred embodiments of the cryostat arrangement according to the invention for storage of a first cryogen, in particular for cooling an arrangement of superconducting magnets 20, with an outer jacket 1, 11 and a first tank 2, 12 installed therein and containing the first cryogen, as well as a second tank 16, 16" with a second liquid cryogen, wherein the first cryogen boils at a lower temperature than the second cryogen, and wherein the first tank 2, 12 comprises a neck tube 4 whose hot upper end 5 is connected to the outer jacket 1, 11 at ambient temperature and whose cold lower end 6 is connected to the first tank 2, 12 at cryogenic temperature.

The cryostat arrangement according to the invention is characterized in that a riser pipe 3, 3', 13 protruding into the second tank 16, 16" is provided, through which the second cryogen can flow out of the second tank 16, 16"; the lower end of the riser pipe 3, 3', 13 ends in the second liquid cryogen in the second tank 16, 16"; a first heat exchanger 7, into which the riser pipe 3, 3', 13 opens directly or indirectly at its upper end; an outflow line 17 connected directly or indirectly to the first heat exchanger 7 is provided, and the second cryogen evaporating out of the first heat exchanger 7 can flow out through this outflow line; and the first heat exchanger 7 is in thermal contact with the neck tube 4, and the neck tube 4 provides local cooling by means of the second cryogen from the riser pipe 3, 3', 13.

The first heat exchanger 7 is preferably arranged above the center of the axial extent of the neck tube 4.

According to the invention, it is thus proposed that the coupling is not realised by a connecting piece whose function is based on thermal conduction in the solid material but instead it is proposed that at least one (or more) heat exchangers be installed at the coupling points on the neck tube 4. These heat exchangers usually have liquid nitrogen flowing through them. The heat exchangers are supplied from the two tanks 16, 16" through the tubular riser pipe 3, 3', 13, which extends as far as the bottom of the second tank 16, 16".

The pressure in the second tank 16, 16" can be adjusted by regulating the outflow rate through a control valve taking into account the atmospheric pressure, so that the desired flow rate and/or the desired height of the liquid level in the riser pipe is obtained for the neck tube cooling. Alternatively, the pressure difference can be established by means of a pump, which is arranged in the outflow line.

In addition, the neck tube section between the heat exchanger and the attachment to the outer jacket may be precooled with the evaporated nitrogen, which further reduces the heat load on the coupling point. However, the reduction in heat load via the exhaust cooling is quite low, so it is necessary to balance between the added complexity and the resulting thermodynamic efficiency.

The temperature gradient in the neck tube segment amounts to approximately 300K over a length of 70 cm, for example, ranging from ambient temperature to the temperature of liquid helium. The neck tube cooling should ideally be mounted as close to the outer jacket as possible such that the temperature gradient from the neck tube cooling to the helium is minimized. However, at the same time, icing of the cryostat on the outside should be prevented. Hence, a good compromise should be sought between effective neck tube cooling to reduce the temperature gradient and prevention of icing.

Figure 1B:
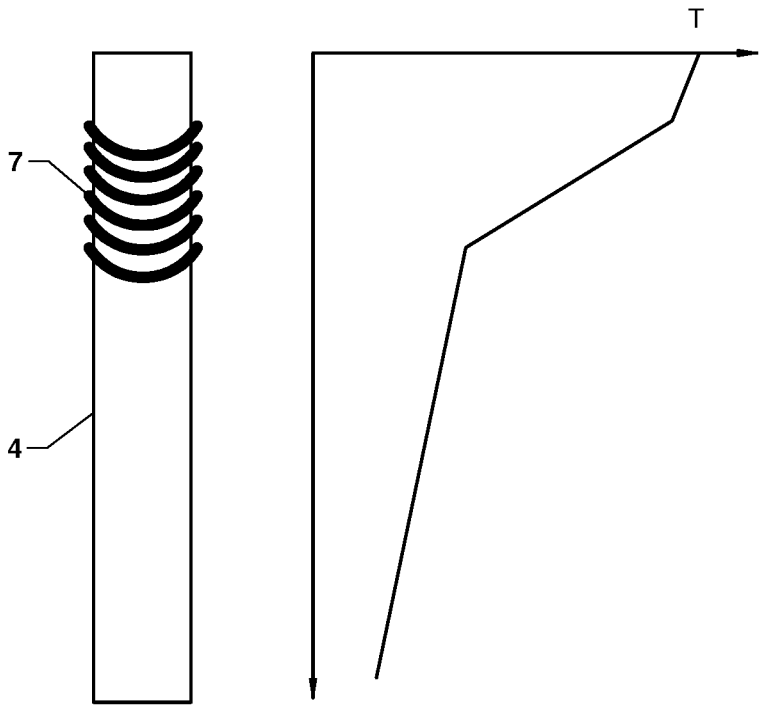
FIG. 1*b* shows a schematic diagram of the temperature curve along the neck tube axis of a cryostat according to the invention.
Figure 2:
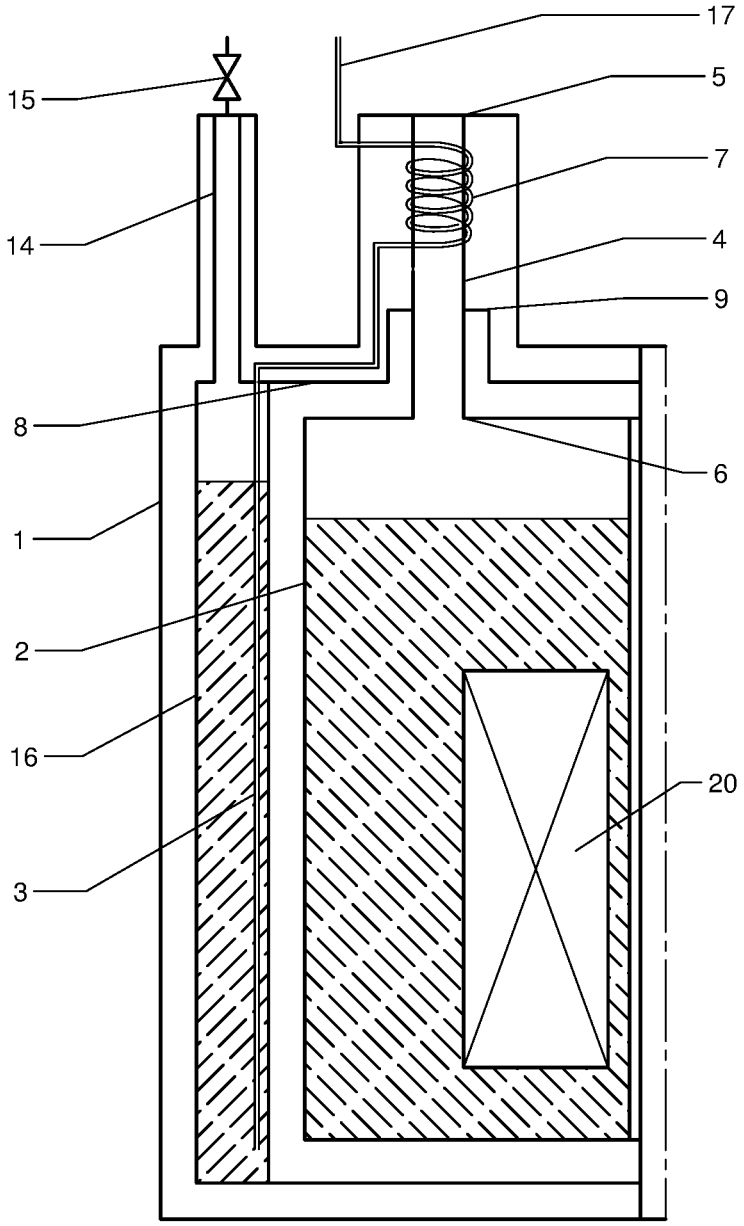
FIG. 2 shows a schematic vertical sectional view of a second embodiment of the cryostat arrangement according to the invention with a cooling loop as the first heat exchanger and a valve at the outlet of the exhaust line out of the second tank.

FIG. 1*b* shows the curve of the temperature T along the neck tube 4 diagramed schematically. The temperature transition at the heat exchanger 7 is crucial for the flattening of the temperature gradient toward the inside. Therefore, less heat enters the first cryogen (usually helium) at the lower boiling point.

The cryostat arrangement according to the invention is preferably configured in such a way that the level of the second liquid cryogen in the riser pipe 3, 3', 13 is higher than the level in the second tank 16, 16" because of the pressure difference between the outflow line 17 and the gas volume over the liquid surface in the second tank 16, 16", in particular being at the level of the first heat exchanger 7, and so that the first heat exchanger 7 is charged with the second liquid cryogen from the riser pipe 3, 3', 13.

With the cryostat arrangement according to the invention, the outer jacket 1, the first tank 2; 12 (helium tank), the second tank 16; 16" (nitrogen tank) and the neck tube 4 usually delimit an evacuated space. In the embodiments of the cryostat arrangement according to the invention in FIGS. 1*a* through 5 as well as in the state of the art as illustrated in FIGS. 6*a* and 6*b*, the first tank 2; 12 is surrounded by at least one radiation shield 8, which is connected in a thermally conducting manner to a contact surface 9 beneath the first heat exchanger 7 on the outside circumference of the neck tube 4.

An exhaust line 14, which is shown in all the embodiments of the invention depicted in the drawing, through which the evaporating second cryogen vents out of the second tank 16, 16", has—as shown in the embodiments according to FIGS. 2 through 5—a flow resistance device 15 on the atmosphere end, which can be designed in particular as a dosing valve, preferably as a control valve, with which the pressure in the nitrogen tank 16, 16" can be controlled. Due to the flow resistance device 15 a pressure difference between the outflow line 17 and the gas volume over the liquid surface in the second tank 16, 16" can be implemented in the exhaust line 14.

In embodiments that are not shown separately in the drawings, the outflow line 17 may have a pump on the atmosphere end, in particular a pump having a dosing valve or having a control valve, preferably a controllable pump so that a pressure difference between the outflow line 17 and the gas line over the liquid surface in the second tank 16, 16" can be implemented by the pump in the outflow line 17.

As shown in FIGS. 1*b* through 5, the first heat exchanger 7 may have at least one pipe loop, preferably a plurality of pipe loops wound around the outside circumference of the neck tube 4, lying in close contact with the outside circumference of the neck tube 4 to provide good thermal contact. In embodiments that are not shown separately in the drawings, the first heat exchanger 7 may however, also have a tube segment arranged radially around the outside circumference of the neck tube 4, with second liquid cryogen, mostly nitrogen, flowing through the tube segment out of the riser pipe 3, 3', 13.

FIGS. 3*a* through 5 show embodiments of the cryostat arrangement according to the invention, in which a second heat exchanger 10, which is in close contact with the outside circumference of the neck tube 4 to provide thermal coupling and provides additional local cooling for the neck tube 4 by means of the second cryogen evaporating out of the first heat exchanger 7, is arranged above the first heat exchanger. In these embodiments, the outflow line 17 is also connected directly or indirectly to a branch piece 18, which is in turn connected to an exhaust line 14 either directly or by way of a flow resistance device 15 and this exhaust line is in turn connected to the second tank 16, 16", so that the cryogen flow rate through the heat exchanger can be adjusted through the control of the pressure in the second tank 16, 16".

Figure 3A:
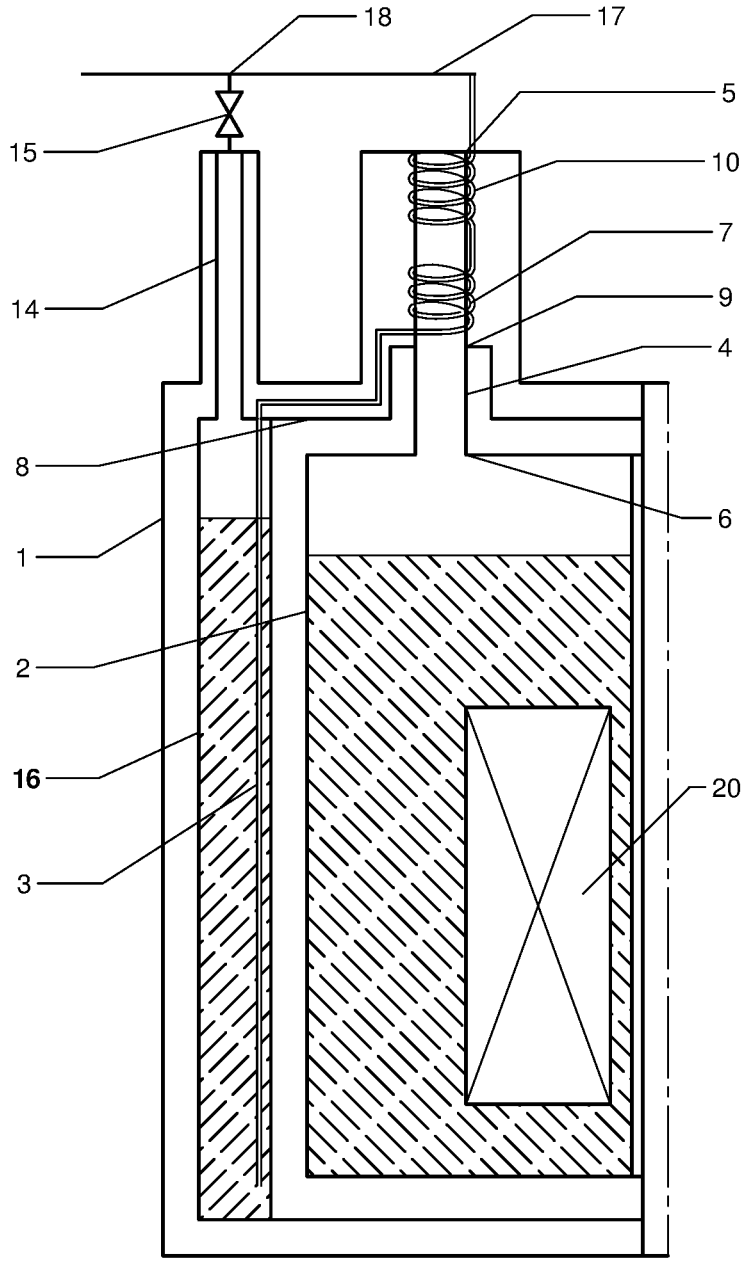
FIG. 3*a* shows a schematic vertical sectional view of a third embodiment of the cryostat arrangement according to the invention with a second heat exchanger on the neck tube and a branch piece between the outflow line out of the heat exchangers and the exhaust line from the second tank.
Figure 3B:
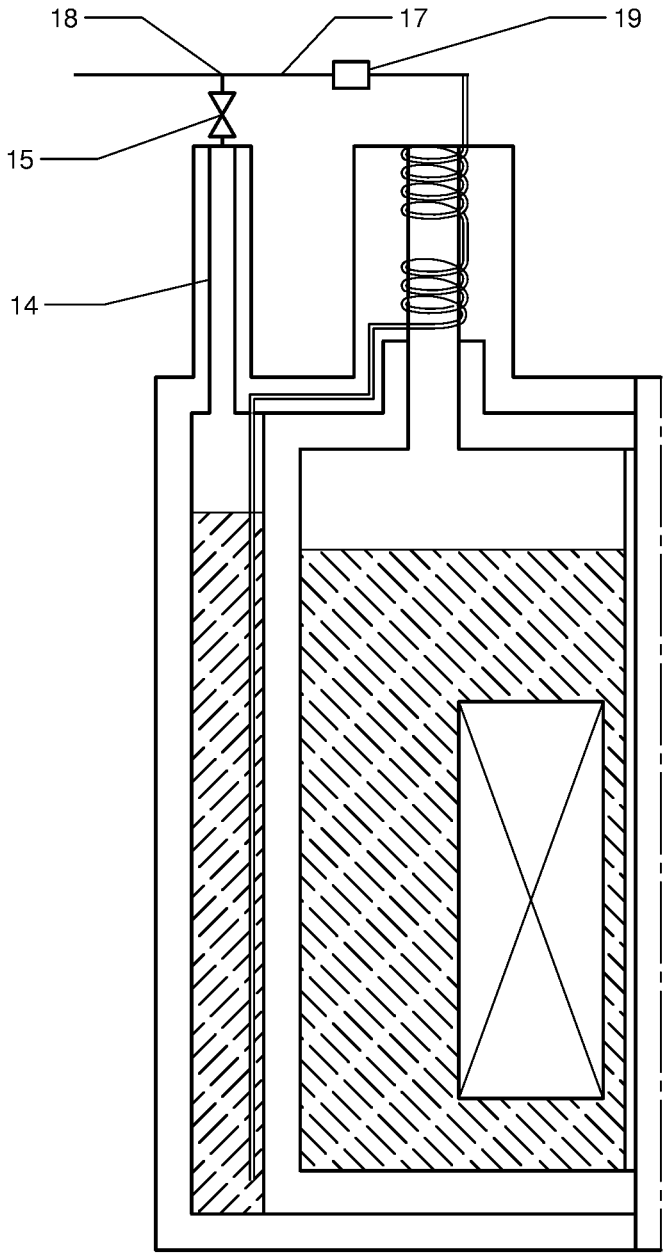
FIG. 3*b* shows an embodiment like that in FIG. 3*a*, but with a flow meter in the outflow line out of the heat exchangers.

In the embodiment according to FIG. 3*b*, a flow meter 19 for determining the flow rate of the second cryogen flowing out through the outflow line 17 is arranged in the outflow line 17. Alternatively, or additionally, a flow meter for determining the flow rate of the second cryogen outgassing through the exhaust line 14 may also be arranged in an exhaust line 14. In both cases control of the pressure in the second tank 16, 16" can thus be achieved.

Figure 3C:
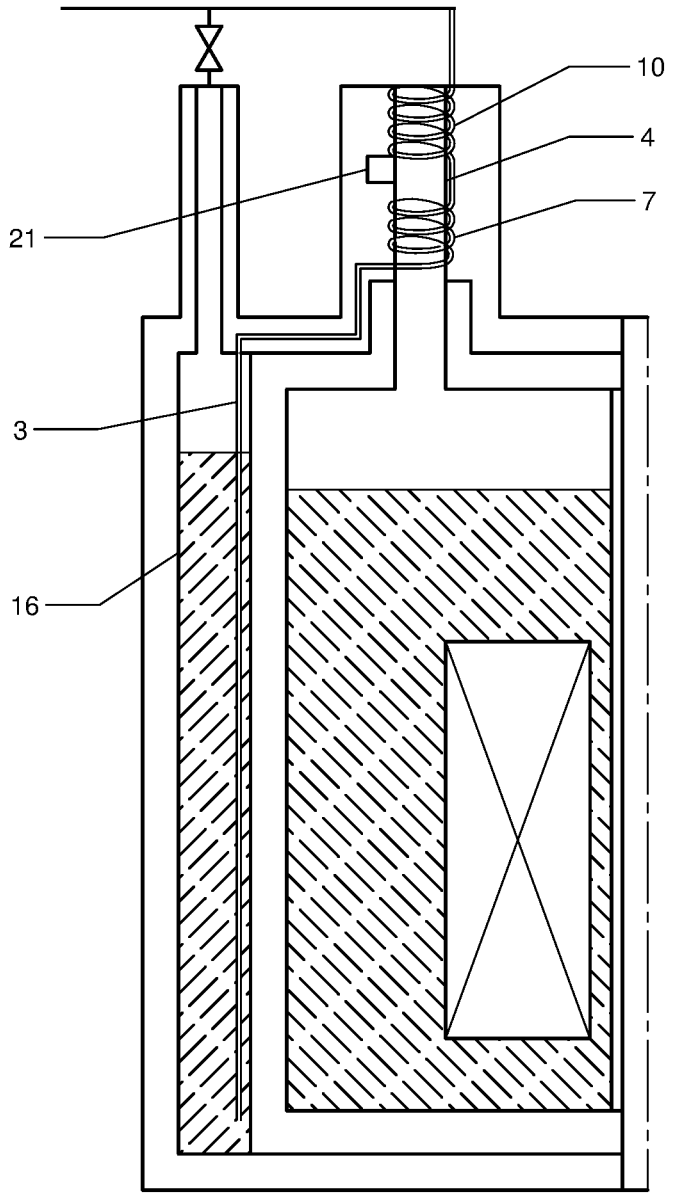
FIG. 3*c* shows an embodiment like that in FIG. 3*a*, but with a temperature sensor on the neck tube.

In the embodiment according to FIG. 3*c*, a temperature sensor 21 is arranged on the neck tube 4 in the region of the first heat exchanger 7 and/or of the second heat exchanger 10. Pressure control of the cryogen pressure in the second tank 16, 16" is also possible with the measured temperature as a manipulated variable.

Figure 3D:
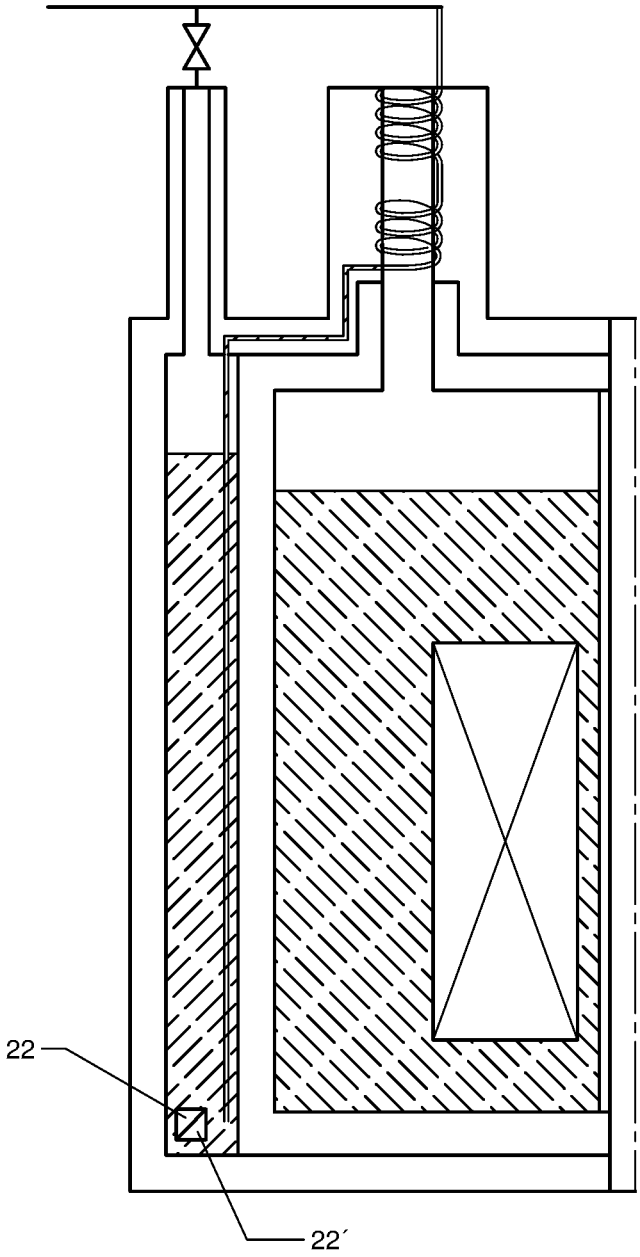
FIG. 3*d* shows an embodiment like that in FIG. 3*a*, but with a pressure sensor and/or filling level sensor in the second tank.

In the embodiment according to FIG. 3*d*, a pressure sensor 22 is provided in the second tank 16, 16", preferably near the bottom, in particular near the lower end of the riser pipe 3, 3', 13 which is designed as an intake section. Alternatively, or additionally, a filling level sensor 22' may also be provided in the second tank 16, 16".

Figure 4:
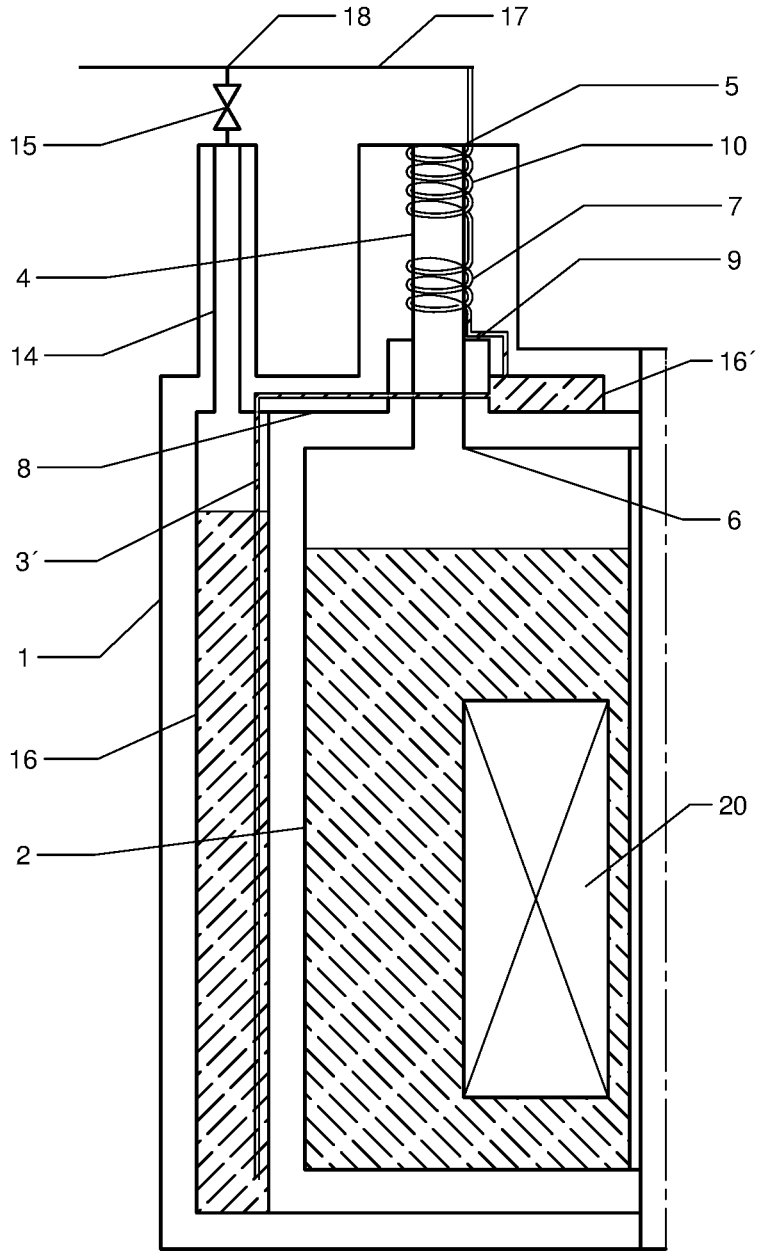
FIG. 4 shows a schematic vertical sectional view of another embodiment of the cryostat arrangement according to the invention with a distributor tank for the second cryogen.

FIG. 4 shows an embodiment of the cryostat arrangement according to the invention in which a distributor tank 16', preferably designed in the form of a ring, is arranged in the outer jacket 1 above the second tank 16, 16", so that it is in thermally conducting contact with the second tank 16, 16", and the second liquid cryogen from the riser pipe 3' can be fed into the second tank, on the one hand, and the second liquid cryogen can be forwarded from this tank to the first heat exchanger 7, on the other hand.

In the embodiment shown here, the distributor tank 16' is arranged on an upper cover lid of the radiation shield 8. This distributor tank 16' causes a drop in temperature of the shield cover and therefore also causes a drop in temperature of the 80K shield in the bore. In addition, the control of the liquid level in the riser pipe, which is described in greater detail below, allows an increase of the amount of the second cryogen stored in the system if the distributor tank 16' has a sufficiently large volume.

Figure 5:
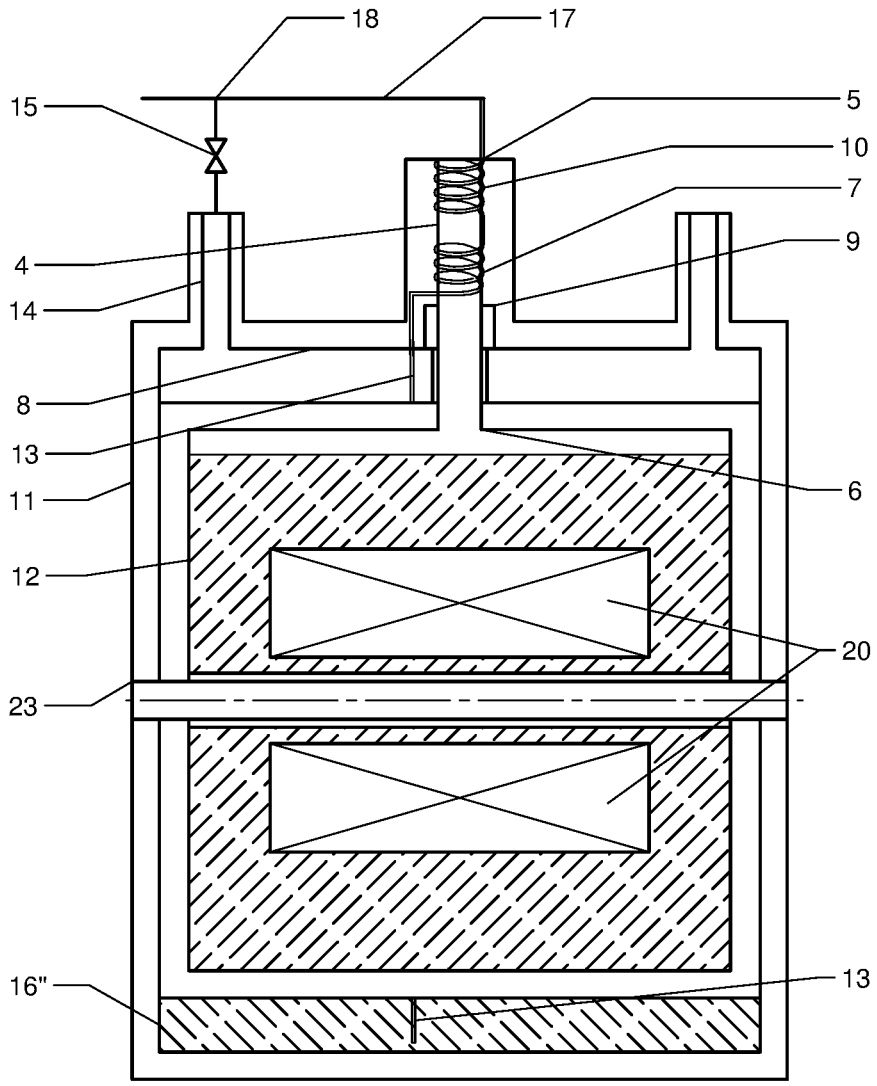
FIG. 5 shows a schematic vertical sectional view of an embodiment of the cryostat arrangement according to the invention, with a horizontal room temperature tube.
Figure 6A:
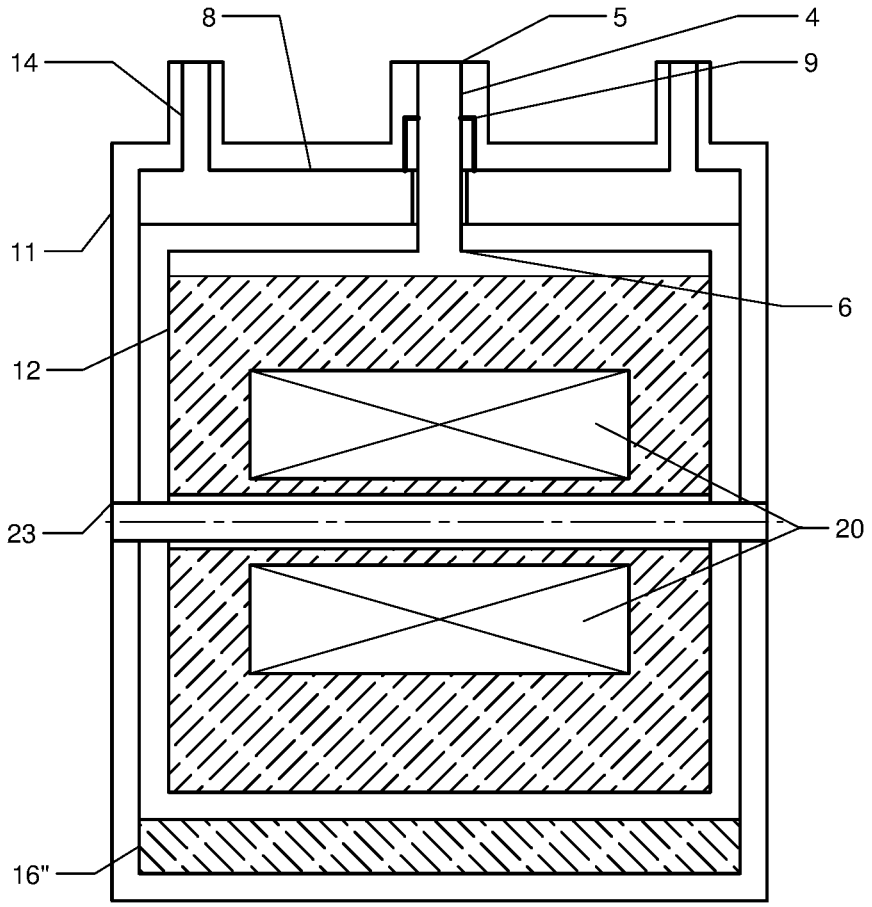
FIGURE 6A (PRIOR ART)
FIG. 6*a* shows a schematic vertical sectional view of a cryostat arrangement according to the state of the art, with a horizontal room temperature tube.
Figure 6B:
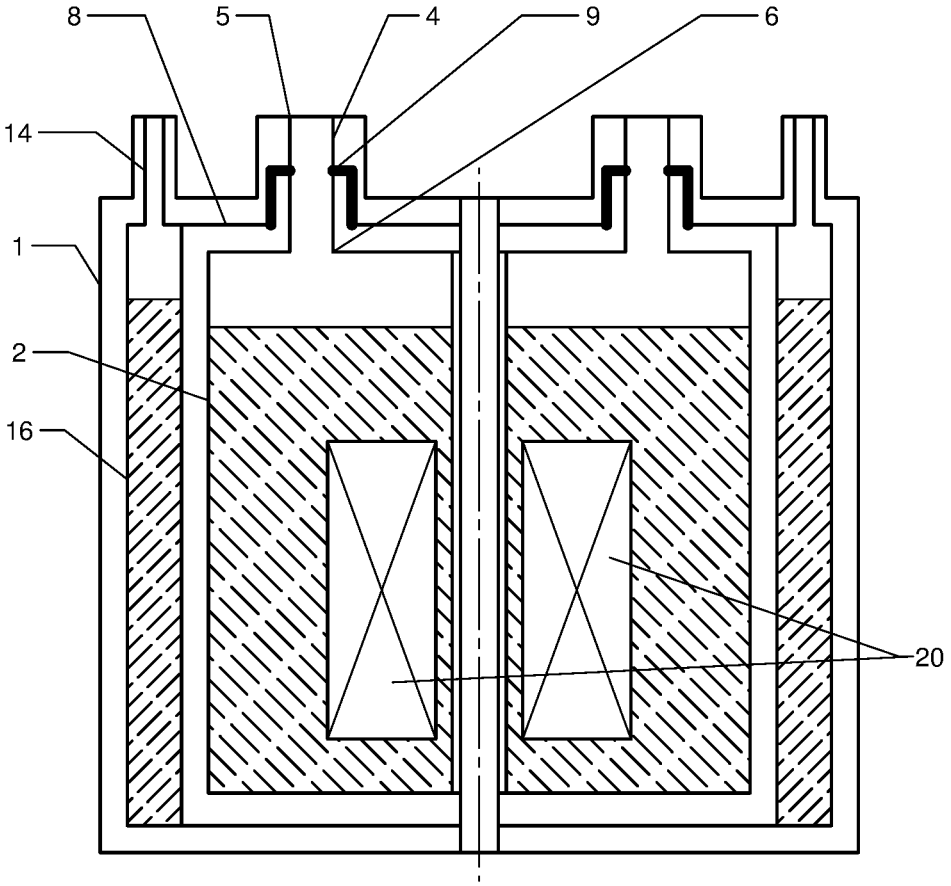
FIGURE 6B (PRIOR ART)
FIG. 6*b* shows a schematic vertical sectional view of a cryostat arrangement according to the state of the art with a vertical room temperature tube.

FIG. 5 shows an embodiment of the invention in which a room temperature tube 23 is provided, passing horizontally through the first tank 12. The second tank 16" may be arranged in the form of a ring around the helium tank 12 (the axis of symmetry of the second tank is also horizontal). The lower end of the riser pipe 13 protrudes into the lower region of the second tank.

FIGS. 6*a* and 6*b* illustrate cryostat arrangements that are known from the state of the art, such as those discussed in detail above.

FIG. 6*a* shows a cryostat arrangement with a horizontal room temperature tube 23 which is comparable to the embodiment of the invention illustrated in FIG. 5—except, of course, for the modifications according to the invention.

Finally, FIG. 6*b* shows a cryostat arrangement with a vertical room temperature tube, such as that described in detail in DE 10 2004 034 729 B4, which was cited in the introduction above.

LIST OF REFERENCE NUMERALS

1, 11 Outer jacket
2, 12 Tank for first cryogen (helium tank)
3, 3', 13 Riser pipe
4 Neck tube
5 Hot upper end of the neck tube
6 Cold lower end of the neck tube
7 First heat exchanger
8 Radiation shield
9 Contact surface
10 Second heat exchanger
11 Outer jacket

12 Tank for first cryogen (helium tank)
13 Riser pipe
14 Exhaust line
15 Flow resistance device (control valve)
16, 16" Tank for second cryogen (nitrogen tank)
16' Distributor tank
17 Outflow line
18 Branch piece
19 Flow meter
20 Magnet arrangement
21 Temperature sensor
22 Pressure sensor
22' Liquid Level Sensor
23 Room temperature tube

The invention claimed is:

1. A cryostat arrangement for storage of a first cryogen, the cryostat arrangement having an outer jacket and a first tank installed within the outer jacket with the first cryogen in addition to a second tank holding a second liquid cryogen, wherein the first cryogen boils at a lower temperature than the second cryogen and wherein the first tank comprises a neck tube whose hot upper end is connected to the outer jacket at ambient temperature and whose cold lower end is connected to the first tank at cryogenic temperature, the arrangement comprising:

a riser pipe protruding into the second tank such that the second liquid cryogen can flow out of the second tank through the riser pipe, a lower end of the riser pipe being located in the second liquid cryogen in the second tank, and a first heat exchanger into which the riser pipe opens directly or indirectly with the riser pipe's upper end, the first heat exchanger having an outflow line such that evaporating second cryogen from the first heat exchanger can flow out through the outflow line, the first heat exchanger being located outside of the neck tube in direct thermal contact therewith so as to provide local cooling via the second cryogen from the riser pipe.

2. The cryostat arrangement according to claim 1, wherein a level of the second liquid cryogen in the riser pipe is above a level in the second tank because of a pressure difference between the outflow line and a gas volume above a liquid surface in the second tank, and the first heat exchanger is fed with second liquid cryogen from the riser pipe.

3. The cryostat arrangement according to claim 1, further comprising an exhaust line through which evaporating second cryogen vents from the second tank, wherein the exhaust line has a flow resistance device and a pressure difference between the outflow line and a gas volume above the liquid surface in the second tank can be controlled by the flow resistance device.

4. The cryostat arrangement according to claim 3, wherein the flow resistance device comprises a control valve.

5. The cryostat arrangement according to claim 1 wherein the outflow line has a pump, and wherein a pressure difference between the outflow line and a gas volume above the liquid surface in the second tank can be controlled by the pump.

6. The cryostat arrangement according to claim 5, wherein the pump comprises a control valve.

7. The cryostat arrangement according to claim 1 further comprising a second heat exchanger arranged in thermal contact with the neck tube above the first heat exchanger, the second heat exchanger providing additional local cooling using evaporating second cryogen from the first heat exchanger.

8. The cryostat arrangement according to claim 7 further comprising a temperature sensor arranged on the neck tube adjacent to the second heat exchanger.

9. The cryostat arrangement according to claim 1 wherein a distributor tank is arranged in thermally conducting contact with the second tank in the outer jacket above the second tank, and wherein second liquid cryogen from the riser pipe is fed into the distributor tank and second liquid cryogen can be conveyed out of the distributor tank into the first heat exchanger.

10. The cryostat arrangement according to claim 9, wherein the distributor tank has the form of a ring.

11. The cryostat arrangement according to claim 1 wherein the outflow line is connected directly or indirectly to a branch piece and the branch piece is connected directly or via a flow resistance device to an exhaust line, and wherein the exhaust line is connected to the second tank.

12. The cryostat arrangement according to claim 1 further comprising at least one of a flow meter located in the outflow line for determining a flow rate of second cryogen flowing out through the outflow line and a flow meter located in an exhaust line through which evaporating second cryogen vents from the second tank for determining a flow rate of the second cryogen outgassing through the exhaust line.

13. The cryostat arrangement according to claim 1 further comprising a temperature sensor arranged on the neck tube adjacent to the first heat exchanger.

14. The cryostat arrangement according to claim 1 further comprising a pressure sensor located in the second tank.

15. The cryostat arrangement according to claim 14 wherein the pressure sensor is located near the lower end of the riser pipe.

16. The cryostat arrangement according to claim 1 further comprising a filling level sensor located in the second tank.

17. The cryostat arrangement according to claim 1 wherein the cryostat arrangement is used for cooling a superconducting magnet assembly as part of a magnetic resonance apparatus.

18. A method for operating a cryostat arrangement according to claim 1, the method comprising adjusting a pressure difference between the outflow line and a gas volume above a liquid surface in the second tank so that there is a flow of the second cryogen through the heat exchanger.

19. The method according to claim 18, further comprising the following steps:

i) detecting at least one parameter selected from
   a) a flow rate on the outflow line or on an exhaust line through which evaporating second cryogen vents from the second tank, using a flow meter,
   b) a temperature on the neck tube, using a temperature sensor,
   c) a pressure difference between a pressure of the second liquid cryogen and a pressure in the outflow line, using a pressure sensor and
   d) a filling level in the second tank, using a filling level sensor, ii) comparing a value of the detected at least one parameter with a predetermined value of that parameter, and iii) adjusting a pressure difference between the outflow line and the gas volume above the liquid surface in the second tank
   a) as a function of a filling level in the second tank or
   b) so that the at least one parameter detected in step (i) is substantially equal to the predetermined value of that parameter.

20. The method according to claim 18 wherein the pressure difference between the outflow line and the gas volume above the liquid surface in the second tank is adjusted by means of a pump or a flow resistance device.

* * * * *